US005507162A

United States Patent [19]

Chhatwal

[11] Patent Number: 5,507,162

[45] Date of Patent: Apr. 16, 1996

[54] EUROCYLINDER-TYPE ASSEMBLY FOR ELECTRONIC LOCK AND KEY SYSTEM

[75] Inventor: Kn S. Chhatwal, Melbourne, Fla.

[73] Assignee: Intellikey Corp., Melbourne, Fla.

[21] Appl. No.: 184,024

[22] Filed: Jan. 24, 1994

Related U.S. Application Data

[63] Continuation-in-part of Ser. No. 596,210, Oct. 11, 1990, Pat. No. 5,337,588.

[51] Int. Cl.[6] ..... E05B 49/02

[52] U.S. Cl. ..... 70/278; 70/283; 340/825.31; 361/172

[58] Field of Search ..... 70/277–283, 413, 70/417; 361/172; 340/825.31

[56] References Cited

U.S. PATENT DOCUMENTS

| | | | |
|---|---|---|---|
| 528,589 | 11/1894 | Brownell et al. | 70/277 |
| 1,695,518 | 12/1928 | Watson | 70/277 |
| 1,789,171 | 1/1931 | Manrique et al. | 70/417 |
| 2,057,301 | 10/1936 | Golokow et al. | 70/277 |
| 2,059,129 | 10/1936 | Maxwell et al. | 70/417 |
| 2,105,304 | 1/1938 | Wagner | 70/277 |
| 4,326,125 | 4/1982 | Flies | 70/277 X |
| 4,399,673 | 8/1983 | Gotanda | 70/278 X |
| 4,798,068 | 1/1989 | Nakauchi | 70/277 X |
| 4,848,115 | 7/1989 | Clarkson et al. | 70/283 X |
| 4,916,927 | 4/1990 | O'Connell et al. | 70/277 X |

FOREIGN PATENT DOCUMENTS

| | | | |
|---|---|---|---|
| 0462316 | 12/1991 | European Pat. Off. | 70/277 |
| 950962 | 10/1956 | Germany | 70/283 |
| 1401281 | 7/1975 | United Kingdom | 70/277 |
| 2231086 | 11/1990 | United Kingdom | 70/277 |
| WO88/00635 | 1/1988 | WIPO | 70/278 |

*Primary Examiner*—Lloyd A. Gall
*Attorney, Agent, or Firm*—Charles E. Wands

[57] ABSTRACT

A 'Eurocylinder' configuration for an electronic lock and key system has a plug fitted into a main body housing which is readily mounted into a mortise of standardized dimensions. The plug has a keyway at one end and a deadbolt-engaging cam at the other end. To operate the lock, an electronic key is inserted into the keyway and, when given permission as a result of an opto-electronic communication exchange between a control processor in the key and a control processor in the lock, the key is rotated so as to operate a deadbolt. A spring biased translatable contact serves as a conductive interface between a flex circuit and a contact on the keyblade. The body also includes a solenoid device which is energized by way of the flex circuit. The solenoid device operates a plunger away from the plug to allow rotation of the plug by the key. The body and plug also include a segmented pin arrangement such that when the key and the plug are rotated from a key insertion position, the key cannot be removed. A front end portion of the elongated portion of the housing contains an opto-electronic communication unit which communicates with a complementary opto-electronic communication unit in the key handle.

32 Claims, 11 Drawing Sheets

EUROCYLINDER-TYPE ASSEMBLY FOR ELECTRONIC LOCK AND KEY SYSTEM

CROSS-REFERENCE TO RELATED APPLICATIONS

The present application is a continuation-in-part of application Ser. No. 596,210, filed Oct. 11, 1990, now U.S. Pat. No. 5,337,588, issued Aug. 16, 1994 entitled "Electronic Lock and Key System," by KN Singh Chhatwal, assigned to the assignee of the present application and the disclosure of which is herein incorporated.

FIELD OF THE INVENTION

The present invention relates in general to electronic key and lock systems, and is particularly directed to a new and improved electronic lock architecture that is configured to conform with what is commonly known in the industry as a 'Eurocylinder' type of lock.

BACKGROUND OF THE INVENTION

In my above-referenced U.S. Pat. No. 5,337,588, I have described an electronic lock and key system, in which each of the respective lock and key devices is provided with on-board intelligence (its own control processor), with the lock supplying power for each of the lock and the key, and wherein communications between the lock and the key are effected by means of a secure bidirectional optical (infrared) communication link. An example of an electronic lock and key system with which the lock and key components described in my above-referenced co-pending application has particular utility is described in co-pending application Ser. No. 843,998 by C. Malinowski et al which is a continuation of application Ser. No. 596,100, filed Oct. 11, 1990, assigned to the assignee of the present application and the disclosures of which are herein incorporated. It should be observed, however, that the hardware structure of such a lock and key system is not limited to a particular type of application, but is intended to be useful in a variety of housing configurations.

A widely employed application where use of this new and improved functionality of such an electronic lock and key system is desired is in what is known as a 'Eurocylinder' design, prevalent in residential buildings, offices and hotels throughout Europe. In accordance with the 'Eurocylinder' standard, the lock hardware has a cylindrical unit or plug that is fitted into a main body housing, the main body being shaped and sized to be mounted into a support structure cavity, such as a mortise, of standardized dimensions for European mortise locks. The cylindrical plug and body are mounted to be generally flush with the support structure (e.g. door mortise). The plug has a keyway at one end and a lock operating element (in the form of a deadbolt-engaging cam) at the other end. To operate the lock, the blade of a mechanical key whose key pattern matches the actuator pattern of the lock's keyway is inserted into the keyway and the key is rotated. Rotating the key rotates the cylinder and thereby the cam, so as to operate the deadbolt.

Now although the electronic lock and key system described in my above-referenced application offers significantly improved security and flexibility as compared with the conventional Eurocylinder lock and key devices, and its replacement for the conventional mechanical design is desired, users of the improved system are faced with the fact that their mounting hardware is configured exclusively for a Eurocylinder-type device, so that to be widely accepted, any retrofit must conform with the dimensions of the standard.

SUMMARY OF THE INVENTION

In accordance with the present invention, I have developed an electronic lock architecture that incorporates the novel features of the electronic lock and key described in my above-referenced application, but in a configuration that conforms with the 'Eurocylinder' type of lock, so that it may readily replace mechanical Eurocylinder type locks without a need to modify the mounting receptacle used to house the existing mechanical unit.

For this purpose, the present invention comprises a new and improved lock structure comprised of a conductive (metallic) Eurocylinder-shaped housing which readily fits within standard Eurocylinder mortise lock fixtures. The cylindrical portion of the housing has a longitudinal bore into which a cylindrical key receiving plug is inserted. The plug is rotatable by the turning of a key that has been inserted into a keyway in the plug and electronically verified to have permission to operate the lock.

A deadbolt-engaging cam is mounted solid with a rear end of the plug. To accommodate the cam, an elongated body portion of the Eurocylinder housing has a cavity that extends from a sidewall portion of the cylindrical portion to a prescribed depth of its interior surface. An arcuate recess is formed in the interior surface of the front end of the bore. The contact holder has an interior surface depression in which a fixed metallic contact element is captured and which serves as a conductive interface between a translatable contact and a flex circuit terminal, so that an electrical circuit path may be provided between the flex circuit and an insulated terminal on the keyblade.

The Eurocylinder-configured body further includes a generally cylindrical cavity that extends from a generally flat land portion at the bottom of a depression that extends from a surface of the elongated curvilinear portion, which is enclosed by a cover. This cavity is configured to accommodate the insertion of a solenoid device. The solenoid device is energized by way of a flex circuit that meanders through a passageway through the lock housing provided for the purpose. Slidably translatable within a bore intersecting the plug is a solenoid plunger. The plug has a bore that is sized to receive the solenoid plunger along an axis alignable with a longitudinal axis of the solenoid. The plunger is biased by a compression spring to normally prevent rotation of the plug. To rotate the plug the solenoid winding is energized so as to withdraw the plunger out of the bore in the plug.

The elongated portion of the housing includes an additional bore transverse from the land portion of the depression and intersects the bore in which the plug is inserted. This additional bore is alignable with a corresponding bore in the plug. Disposed within and slidably translatable along the axis of the additional bore is a first pin that is biased by a compression spring toward the plug. The corresponding bore in the plug has a bore extending through the sidewall of the plug to a prescribed depth in the keyway. This corresponding plug bore contains a second pin which is of such a length that when the key is properly inserted into the keyway the corresponding plug bore is axially aligned with the additional bore and the second pin is captured within a detent in keyblade. In addition a flat end portion of the second pin is flush with the outer cylindrical surface of the plug and an end surface of the first pin. Since the flat end portion of the second pin is flush with the outer cylindrical surface of the plug, the plug can be rotated.

When the key and the plug are rotated from this aligned, insertion position, the key cannot be removed. Only when the key and plug are rotated into the insertion position can the key be removed. Pressure of the second pin against the aligned first pin compresses the compression spring and allows the second pin to ride up into the bore in the body, so that the second pin may clear the keyblade detent and the key extracted. When the key is removed from the keyway the second pin drops down to a position determined by the depth of the bore in the plug.

A front end portion of the elongated portion of the housing includes a cavity that is configured to receive an opto-electronic communication unit. This opto-electronic communication unit has a pair of opto-electronic transmit and receive devices, which are fit into respective bores of a solid endwall of the communication unit. These modules are operative to communicate with mutually aligned receive and transmit opto-electronic modules of an opto-electronic communication unit within a handle portion of the key. Electrical connections to the opto-electronic modules of the lock housing are provided by way of respective conductor tracks of the flex circuit.

A rear face of the endwall of the opto-electronic communication unit of the lock housing opens into a cavity that is sized to accommodate the insertion of the flex circuit and also a flexible conductive link member which is connected to one of the conductors of the flex circuit. The flex circuit serves to carry power and electrical communication signals used by the electrical and electronic components of the lock.

In order to substantially reduce the ability to tamper with the lock, a plurality of auxiliary bores containing material such as hardened steel pins or the like are provided, thereby making it difficult to penetrate by force (e.g. drill) through the front of the lock for the purpose of gaining access to lock components.

The keyway in the plug extends through the plug from a front circular face to a rear circular face. The keyway has conventional guide ridges with which corresponding grooves on the key must conform. The plug also has a generally cylindrical slot transverse to the keyway. The slot receives an insulating contact insert, which has a spherically contoured outer surface from which extend a pair of tabs that fit within a channel formed within one side of the keyway, so that the contact insert may be captured in the slot. The contact insert has a first cylindrical bore which extends from its outer spherical surface to a base, and a second, reduced diameter bore formed in the base.

A conductive cap fits within the first bore of the contact insert. The conductive cap has a generally spherically contoured base portion which is continuous with a cylindrical wall portion. Slidably disposed within a cylindrical wall portion of the cap is a translatable metallic contact, having a generally spherical solid nipple portion that is contiguous with a slightly wider diameter, generally cylindrical base portion. The nipple portion passes through the second bore in the contact insert and protrudes just beyond the rear surface of its base.

The metallic contact has a bore that accommodates one end of a compression spring, the other end of which is seated against the interior surface of the spherically contoured conductive cap. The dimensions of the plug slot, contact insert, conductive cap and metallic contact are such that the nipple portion of the metallic contact does not enter the keyway, so that metallic contact will not be contacted by the conductive keyblade when the keyblade is inserted into the keyway. Instead, the slight protrusion of the nipple portion of contact through the bore of the contact insert is such that the nipple portion of the metallic contact will be physically and electrically engaged by a raised terminal contact of the key, which is insulated and physically offset from the main body of the keyblade. Thus, when the key is inserted into the keyway, the conductive blade slides through the keyway until the keyblade is fully seated, with the pin in the plug being captured in the keyblade detent. In this position, the raised terminal contact engages the metallic contact pushing against the bias of its compression spring so as to provide an electrically conductive path from the raised terminal contact through the translatable contact to the metallic cap.

The outer surface of the spherically contoured base portion of the metallic cap contacts the fixed metallic contact, that is captured in the interior surface depression of the insulating contact holder. The interior surface depression in the contact holder adjoins a generally circular end of a recess formed in the exterior curved surface of the contact holder. The recess has a generally elongate portion that extends from the circular end along the exterior surface of the contact holder. The elongate portion of the recess receives a 'positive battery' contact segment of a flex circuit. One end of this flex circuit segment has a generally disc-shaped pad which is intimately electrically bonded to the contact element retained in the contact holder. The other end of the flex circuit segment is connected to the main flex circuit, so that a positive battery bus connection is provided via the flex circuit to the insulated terminal contact on the keyblade. Thus, the flex circuit structure provides a conductive power link for one (+) of the battery terminals, while the metallic body of the lock and the conductive keyblade provide a (ground) link for the other (–) battery terminal.

BRIEF DESCRIPTION OF THE DRAWINGS

FIG. 30 is a diagrammatic front sectional view of the Eurocylinder-type lock of FIG. 1 showing the moveable contact components of the plug;

DETAILED DESCRIPTION

Figure 1:
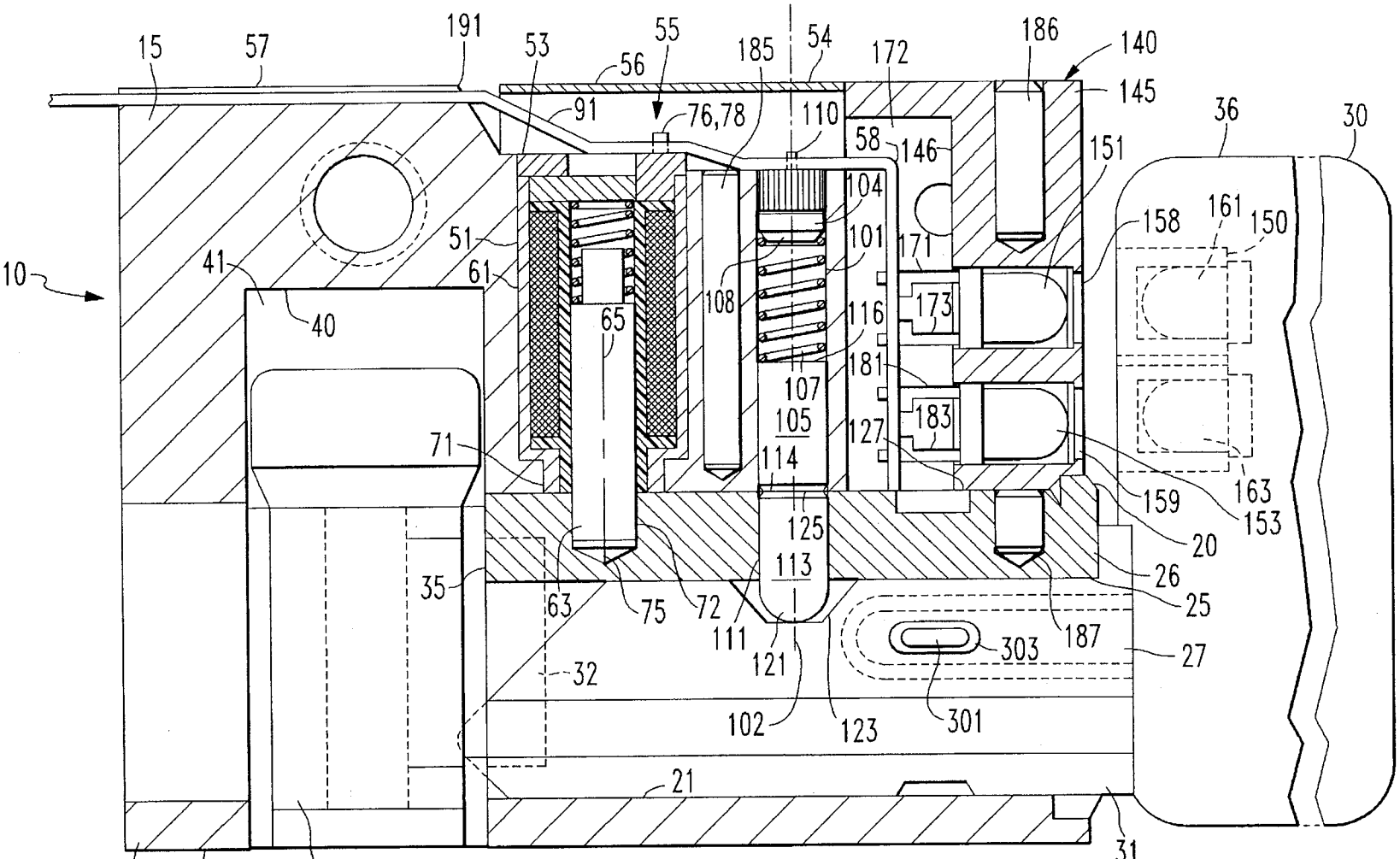
FIGS. 1 and 2 are respective diagrammatic interior side and exterior front end views of a Eurocylinder-conformal electronic lock in accordance with the present invention.
Figure 2:
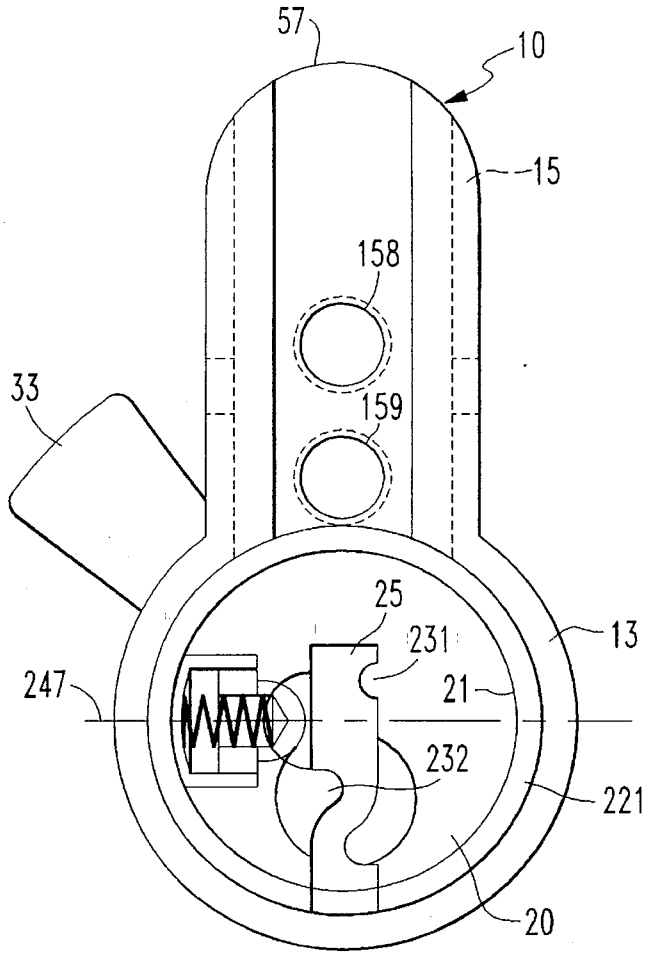

Referring initially to FIGS. 1 and 2, respective diagrammatic interior side and exterior front end views of the Eurocylinder-conformal electronic lock in accordance with the present invention, while FIGS. 3–7 show the configuration of the body portion of the lock in greater detail, as will be described. As shown, the lock comprises a conductive (metallic) Eurocylinder-shaped housing or body 10 having a generally cylindrical body portion 13 from a side portion of which extends a generally elongated curvilinear portion 15. The cylindrical body portion 13 has a first, generally cylindrical longitudinal cavity or bore 21 that is configured to accommodate a generally cylindrical key-receiving plug 20, which is intended to be rotatable within bore 21 of the cylindrical body portion 13 of the housing, by the turning of a key that has been inserted into a keyway in the plug and electronically verified to have permission to operate the lock, as will be described.

More particularly, as shown in FIGS. 1 and 2, plug 20 has a keyway 25 into a first or front end 27 of which the blade of an electronic key, diagrammatically shown at 30 in FIG. 1, is inserted in the course of operating the lock. A deadbolt-engaging cam 33 is mounted solid (as by way of a conventional clutch mount diagrammatically illustrated at 32) with a second or rear end 35 of the cylindrical plug. To accommodate cam 33, body 10 has a second cavity 41 that extends from a sidewall 43 portion of the cylindrical portion 13 to a prescribed depth of its interior surface 40 in the elongated curvilinear portion 15. When the key 30 rotates the plug 20, the cam 33 is also rotated in cavity 41 and thereby engages a deadbolt (not shown), so as to open the lock.

Figure 3A:
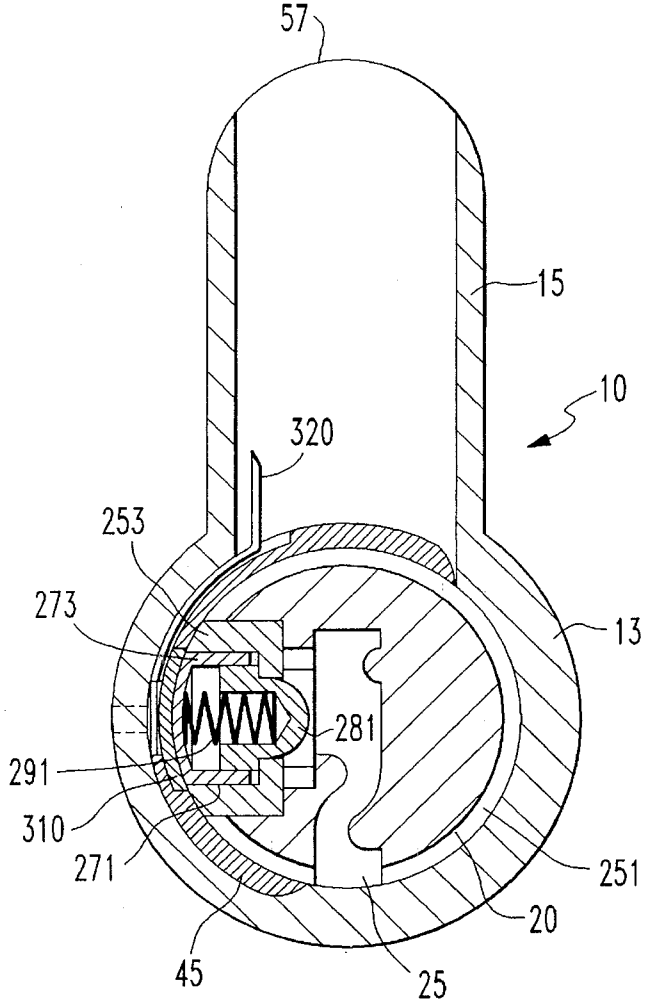
FIG. 3 is a partial interior side view of the interior of the Eurocylinder of FIG. 1.
Figure 3:
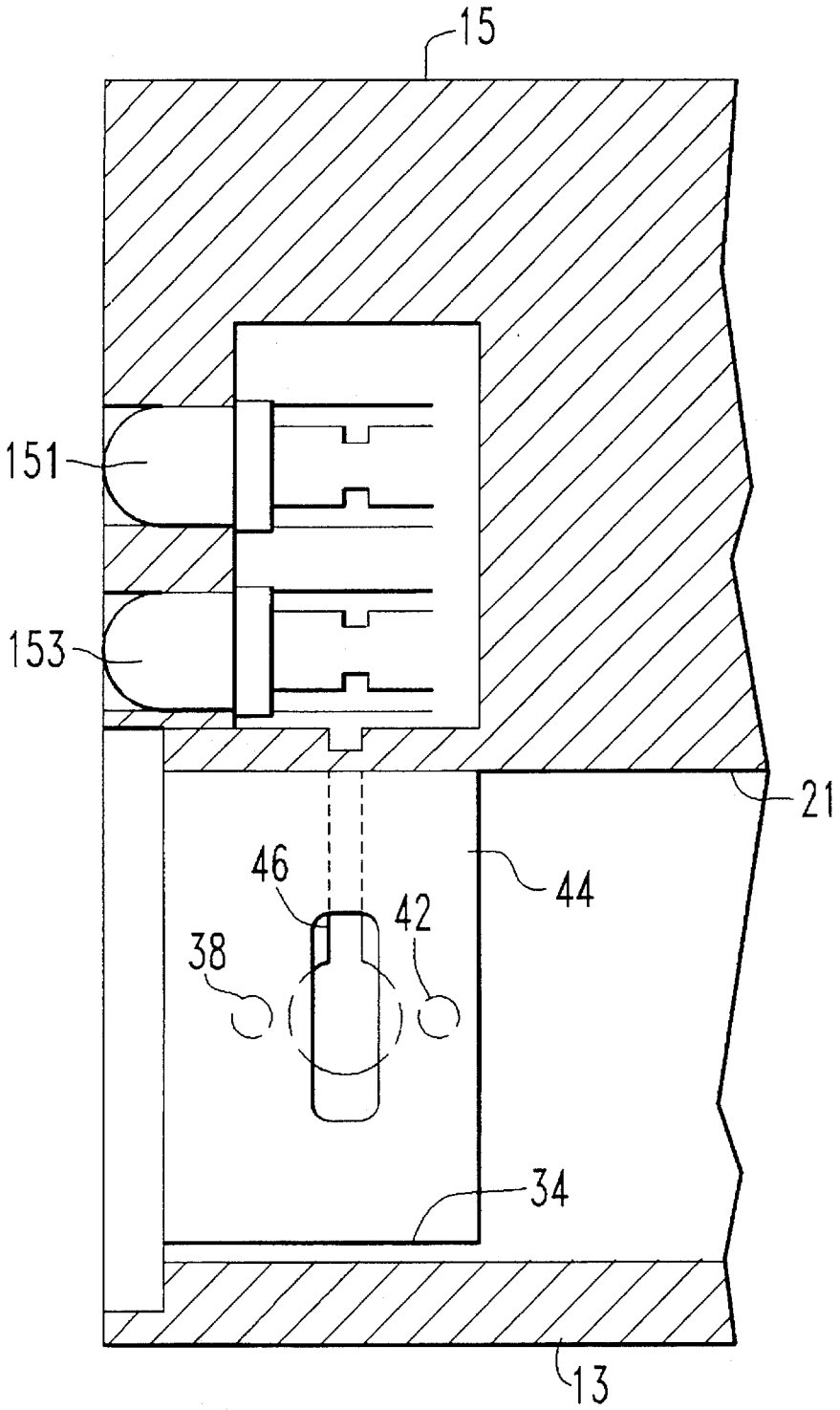
Figure 4:
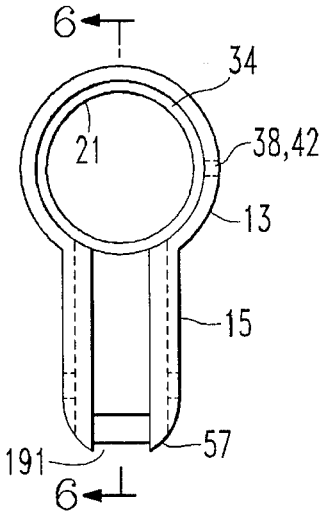
FIG. 4 is a front elevation view of the body of the Eurocylinder-type lock in accordance with an embodiment of the invention.
Figure 5:
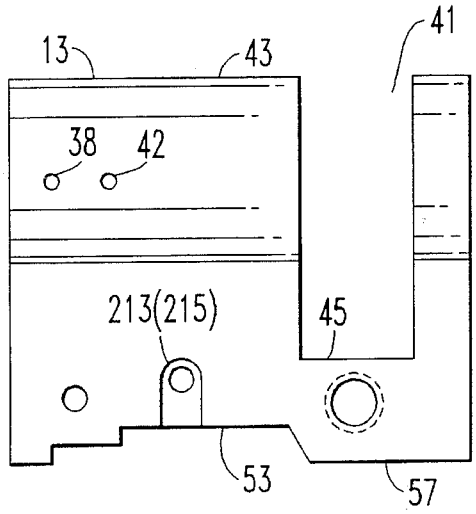
FIG. 5 is a side elevation view of the body of the Eurocylinder-type lock in accordance with an embodiment of the invention.
Figure 6:
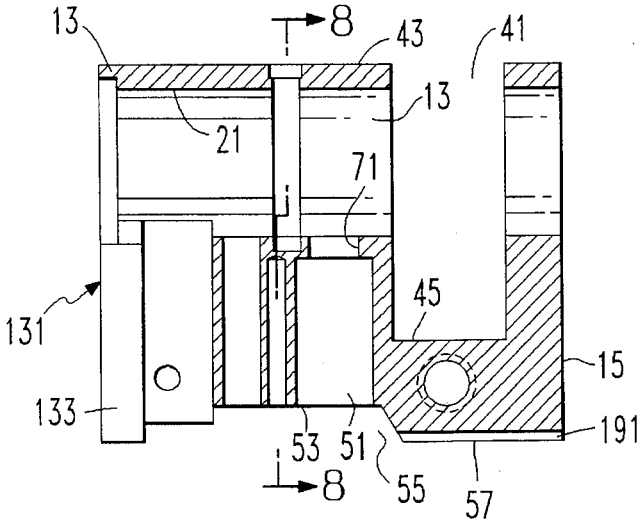
FIG. 6 is a side sectional view of the body of the Eurocylinder-type lock in accordance with an embodiment of the invention taken along lines 6—6 of FIG. 4.

As shown in detail in FIG. 3 and 4, an arcuate recess 34 having a generally rectangular perimeter is formed in the interior surface of the front end of bore 21 and is provided with a pair of mounting holes 38, 42 for receiving corresponding mounting posts of an insulating contact holder 44 to be described below with reference to FIGS. 39–42. As will be described, contact holder 45 has a generally rectangular depression or recess 46, in which a fixed metallic contact, such a beryllium copper element, is captured and which serves as a conductive interface between a translatable contact and a flex circuit terminal, so that an electrical circuit path may be provided between the flex circuit and an insulated terminal on the keyblade.

Figure 11:
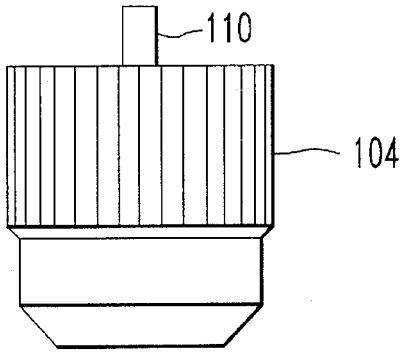
FIGS. 11 shows a retaining pin.

The Eurocylinder-configured body 10 of the present invention further includes a generally cylindrical third cavity or bore 51 that extends from a generally flat land portion 53 at the bottom of a depression 55 extending from bottom surface portion 57 in elongated curvilinear portion 15. In the course of final assembly depression 55 is enclosed by a cover 56, shown in detail in FIGS. 11 and 12, to be described. Bore 51 communicates with the first cavity 21 and is configured to accommodate the insertion of a solenoid device, shown generally at 61.

Figure 10:
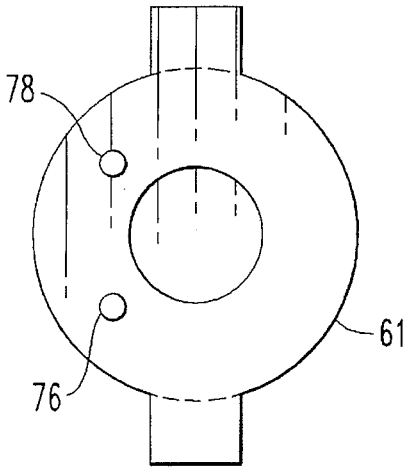
FIG. 10 is a diagrammatic top end view of the solenoid device of FIG. 9.
Figure 9:
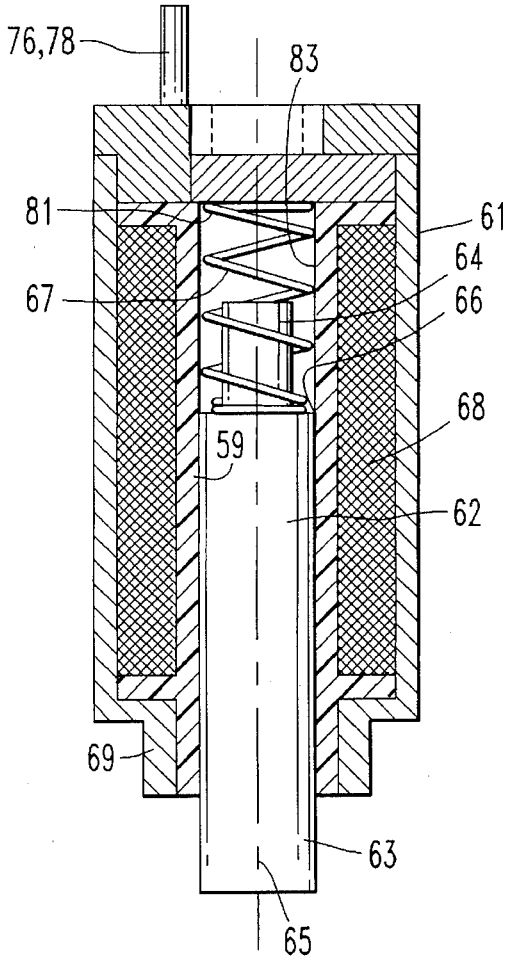
FIG. 9 is a diagrammatic side sectional view of a solenoid device employed in the electronic Eurocylinder lock of FIG. 1.

As diagrammatically shown in the detailed side sectional view of FIG. 9 and the top view of FIG. 10, solenoid device 61 is generally cylindrically configured of interior end and cylindrical sidewalls of plastic material 59, having a longitudinal bore 62 surrounded by a winding 68. Energization current for winding 68 is supplied by way of a pair of electrical terminals 76, 78 that are sized and positioned to be electrically coupled to respective links of a flex circuit (diagrammatically shown at 91 in FIG. 1) as will be described. Slidably translatable within bore 62 is a movable plunger 63 made of low reluctance magnetic material that is translatable along a longitudinal bore axis 65. Axis 65 intersects bore 21 in the cylindrical body portion 13 of the housing.

As diagrammatically shown in FIG. 1, the bottom of cavity 51 has a reduced diameter cylindrical bore 71 that is sized to receive a bottom portion 69 of solenoid device 61. Cylindrical plug 20 has a bore 72 that is sized to receive solenoid plunger 63 and has a longitudinal axis 75 that is alignable with longitudinal axis 65 of the solenoid. Plunger 63 is normally mechanically biased by a compression spring 67 that rides on a stem 64 of plunger 63 and is fitted between a rear surface 66 of plunger 63 and the bottom interior surface 81 of the longitudinal cylindrical bore 62 of solenoid device 61.

In the absence of the energization of solenoid winding 68, spring 67 is operative to normally bias plunger 63 into the bore 72 of the cylindrical plug 20, and thereby prevent rotation of the plug. In order for the plug 20 to rotate within bore 21, the solenoid winding 68 must be energized thereby translating the plunger 63 out of the bore 72 in the plug 20.

The elongated portion 15 of body 10 further includes a fourth, generally cylindrical bore 101 that extends generally transversely from the land portion 53 of depression 55 and intersects bore 21. Bore 101 is sized and located so as to be alignable with a bore 111 of plug 20, which is rotatably captured in bore 21 of the generally cylindrical body portion 13. Disposed within and slidably translatable along an axis 102 of bore 101 is a generally cylindrical pin 105 that is biased by a compression spring 107, seated between a cylindrical retaining pin 104, shown in detail in FIG. 11, and the bottom 106 of pin 105, toward the bore 21 in which cylindrical plug is inserted. The outer cylindrical surface of retaining pin 104 is approximate the diameter of bore 101 and has a knurled surface so as to allow retaining pin to be press fit into bore 101. Retaining pin 104 is inserted into bore 101, so that its bottom surface 108 is flush with land 53 of depression 55. Extending from the bottom surface 108 of retaining pin 104 is a grounding post 110, that is sized to fit in a corresponding hole in flex circuit 91 and serves to provide both a circuit ground and to anchor the flex circuit at that point.

Figure 8:
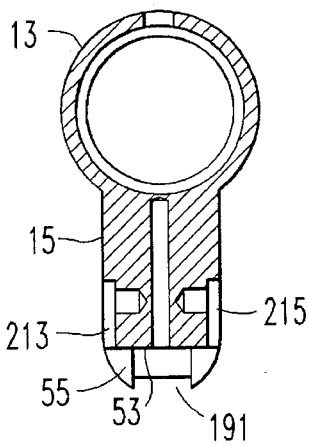
FIG. 8 is a sectional view of the body of the Eurocylinder-type lock in accordance with an embodiment of the invention taken along lines 8—8 of FIG. 6.
Figure 7:
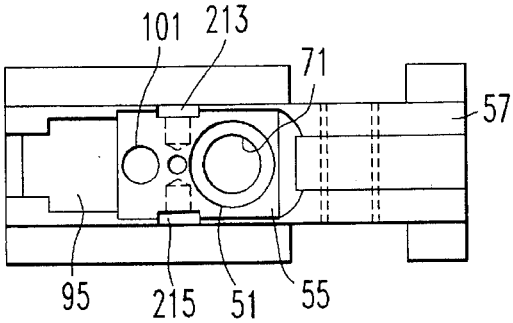
FIG. 7 is a plan view of the body of the Eurocylinder-type lock in accordance with an embodiment of the invention.
Figure 12:
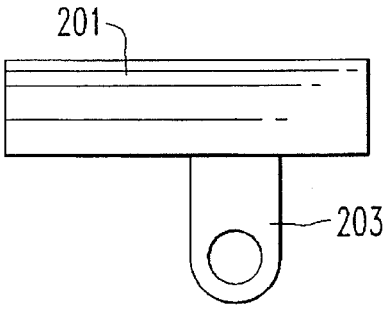
FIGS. 12 and 13 are respective end and side views of a cover for the solenoid depression of the housing structure of FIG. 1.
Figure 13:
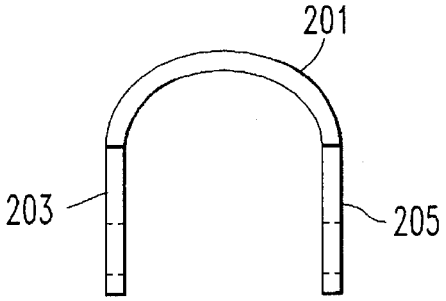

As noted earlier, depression 55 is enclosed by a removable cover 56, shown in detail in FIGS. 12 and 13, that permits access to solenoid device 61, pins 105, 113 and flex circuit 91. Cover 56 has a partial cylindrical wall 201 from which extend a pair of leg portions 203, 205, which may be attached by screws or the like to corresponding slots 213, 215 in body 10, shown in FIGS. 5 and 7 and 8. Alternatively, the cover 56 may be formed as an extended unitary part of opto-electronic communication unit 140.

As will be described in detail below, plug 20 has a bore 111 of the same diameter as bore 101, with bore 111 extending through the cylindrical sidewall 26 of the plug 20 to a prescribed depth in the keyway 25. Bore 111 also contains a pin 113. The length of pin 113 is such that, when the key is properly inserted in the keyway 25 in the position shown in FIG. 1, bore 111 in plug 20 is axially aligned with bore 101 of elongated body portion 15, and a rounded head portion 121 of the pin 113 is captured within a detent 123 in keyblade 31, on the one hand, and a second flat end portion 125 of pin 113 is flush with the outer cylindrical surface 127 of plug 20 and an end surface 114 of pin 105. Since the flat end portion 125 of pin 113 is flush with the outer cylindrical surface 127 of plug 20, the plug 20 can be rotated in bore 21.

When the key 30 and plug 20 are rotated from this aligned, insertion position, the key cannot be removed, since the second flat end portion 125 of the pin 113 is no longer in axial alignment and flush with the end surface 114 of pin 111. Only when the key 30 and plug 20 are rotated into the insertion position can the key be removed, since it is in this position that the second flat end portion 125 of the pin 113 is in axial alignment and flush with the end surface 114 of pin 111, so that as the key is pulled out of the keyway, the rounded head portion 121 of pin 113 is moved axially in bore 111 by contact pressure of keyblade detent 123. Pressure of pin 113 against pin 105 compresses spring 107 and allows pin 113 to ride up into bore 111, so that the rounded head portion 121 may clear the keyblade detent 123, whereby the key can be extracted. When the key is removed from the keyway 25, pin 113 drops back down to a position determined by the depth of bore 111 in plug 20.

A front end portion 131 of the elongated portion 15 of body 10 includes a fourth cavity 133 that is configured to receive an opto-electronic communication unit, shown at 140 in FIG. 1, and illustrated in detail in FIGS. 14–18. Opto-electronic communication unit 140 has a pair of opto-electronic transmit and receive devices, shown in FIG. 1 as an infrared transmitter module 151 and an infrared receiver module 153, of the type described in my above-referenced co-pending application, which are fit into respective bores 141 and 143 of a solid endwall 145 of unit 140. Modules 151 and 153 are operative to communicate with mutually aligned receive and transmit opto-electronic modules 161, 163 of an opto-electronic communication unit 150, diagrammatically shown at 150 within a handle portion 36 of the key 30.

Electrical connections to opto-electronic modules 151 and 153 are provided by way of terminal posts 171, 173 and 181, 183 respectively, which extend from a rear face 146 of endwall 145 and attach to respective conductor tracks of flex circuit 91, as will be described with reference to FIG. 19. At a front or face portion 144 of endwall 145, bores 141, 143 have respective circular recesses 156, 157 which receive lenses 158, 159.

Figure 43:
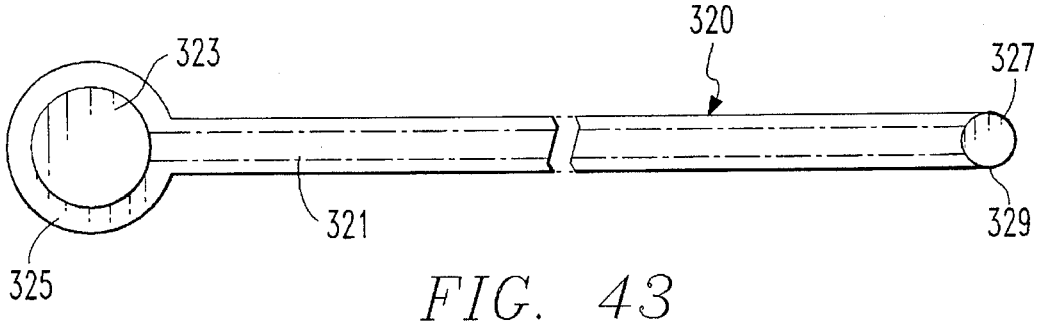
FIG. 43 shows a flex circuit segment for the contact holder of FIGS. 39–42.

Rear face 146 of endwall 145 of unit 140 opens into a cavity 172 that is sized to accommodate the insertion of multi-conductor flex circuit 91, and also a flexible conductive link member, or flex circuit segment (not shown in FIG. 1, but described in detail below with reference to FIG. 43), which is connected to one of the conductors of the flex circuit 91. As described above, flex circuit 91 serves to carry power and electrical communication signals used by the electrical and electronic components of the lock.

As diagrammatically illustrated in FIG. 1, cavity 172 adjoins depression 55, so as to provide an unobstructed path (shown in FIG. 1 as having a right angle turn 58) through which flex circuit 91 may extend. Flex circuit 91 exits body 10 by way of a channel or recess 191 in bottom surface portion 57 of elongated curvilinear portion 15.

In order to substantially reduce the ability to tamper with the components of the lock, a plurality of auxiliary bores are bored into body 10, as shown at 185, 186 and 187 in FIG. 1. A material such as hardened steel pins or the like are inserted into these bores, thereby making it extremely difficult to gain forced entry as by drilling through the front of the lock for the purpose of gaining access to respective lock components such as the solenoid device 61, flex circuit 91 and locking pin 113.

Figure 19:
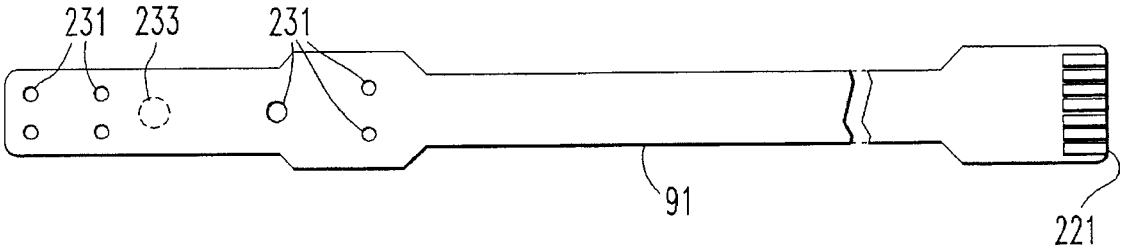
FIG. 19 shows a flex circuit.

Flex circuit 91 is shown in detail in FIG. 19 as a generally elongated, thin dielectric strip, such as Mylar, in which are embedded a plurality of conductive tracks that extend from respective ones of a plurality of terminal pads 221. Distributed along the flex circuit strip are respective access holes 231 to allow external connections to be made to the embedded conductor tracks in the flex circuit strip. In addition, a center track of the flex circuit is connected to a pad region shown at 233, in order to provide a power bus connection to an insulated power terminal on the keyblade, as will be described.

Referring now to FIGS. 20–26, the generally longitudinal cylindrical key-receiving metallic plug 20, which is illustrated in FIG. 1 as being rotatably captured within bore 21 of the metallic cylindrical body portion 13 of the lock, is shown as having a keyway 25 which extends through the plug from front circular face 221 to a rear circular face 223. Keyway 25 has conventional guide ridges 231, 232 with which corresponding grooves on the key must conform, as well as a key lead chamfer 235. Keyway 25 is sized to receive the conductive blade portion 31 of an electronic key 30, diagrammatically shown partially in FIG. 1 and shown in FIGS. 27–29.

Plug 20 also has a generally cylindrical slot or bore 241 having an axis 247 that is generally transverse to the longitudinal axis 249 of keyway 25. Bore 241 extends from the outer wall surface 243 to the keyway 25. An annular groove 251 is formed to a prescribed depth in the surface 243 of the plug, so as to intersect bore 241. Annular groove 251 serves to prevent a short circuit between a fixed contact 310 (of positive polarity, for example, and shown in FIG. 37, to be described) and key-receiving plug 20 (of negative polarity, for example), when the plug 20 is rotated by key 30. An annular groove 252 is also formed to a prescribed depth in the surface of the plug for receiving an O-ring (not shown) for capturing the plug in the cylindrical body.

Figure 31:
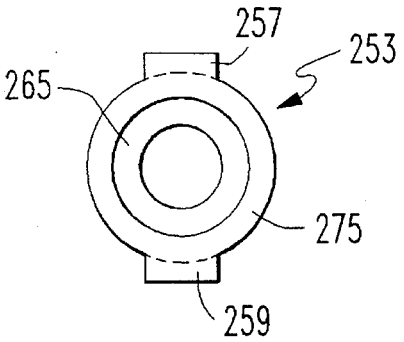
FIGS. 31 and 32 are respective end and side sectional views of a contact insert.
Figure 32:
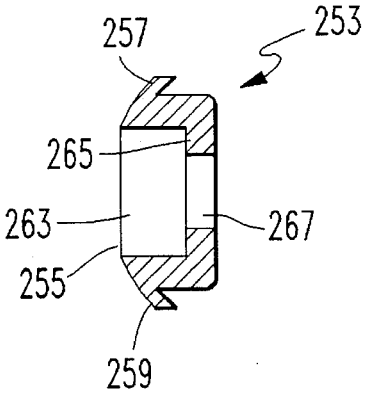
Figure 17:
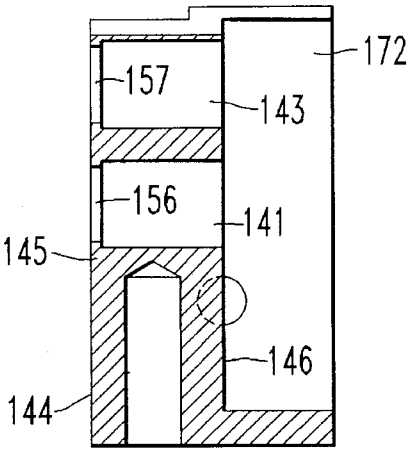
FIG. 17 is a side sectional view of the opto-electronic unit of FIG. 1 taken along lines 17—17 of FIG. 16.
Figure 16:
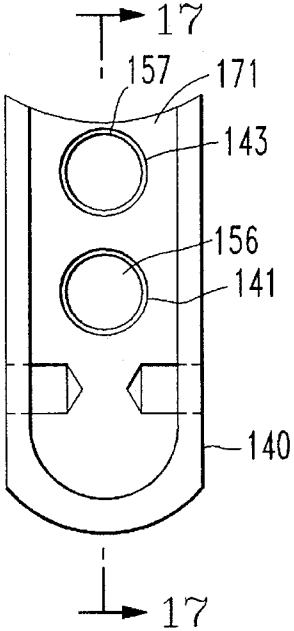
FIG. 16 is a rear end view of the opto-electronic unit of FIG. 1.
Figure 15:
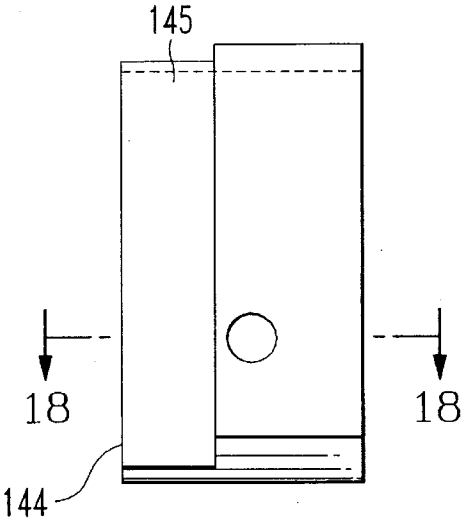
FIG. 15 is a side elevation view of the opto-electronic unit of FIG. 1.
Figure 18:
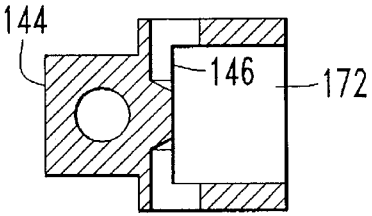
FIG. 18 is a top sectional view of the opto-electronic unit of FIG. 1 taken along lines 18—18 of FIG. 15.
Figure 14:
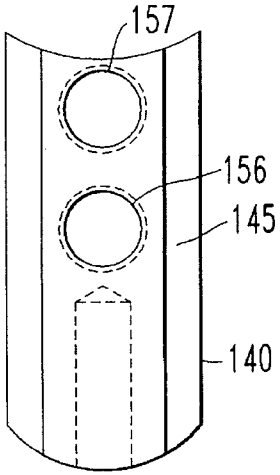
FIG. 14 is a front end view of the opto-electronic unit of FIG. 1.
Figure 21:
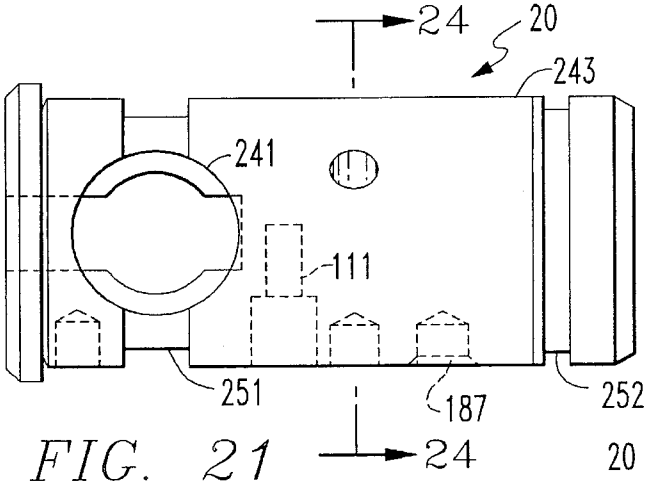
FIG. 21 is a side elevation end view of the plug 20 of FIG. 1.
Figure 23:
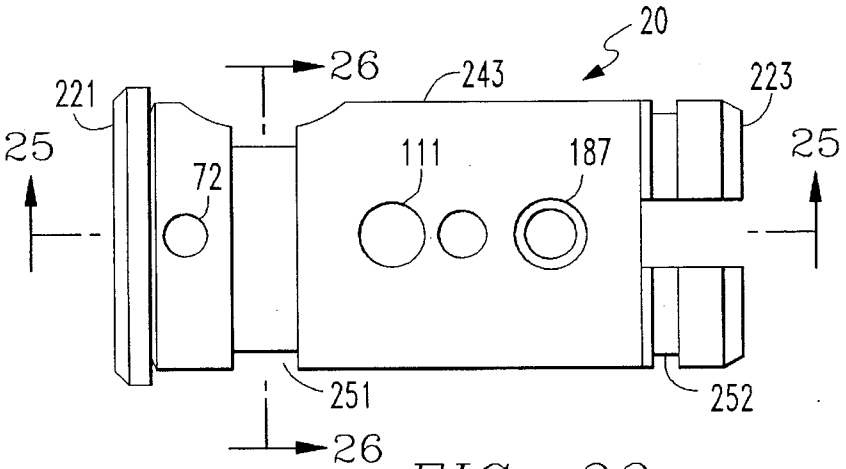
FIG. 23 is a top view of the plug 20 of FIG. 1.
Figure 20:
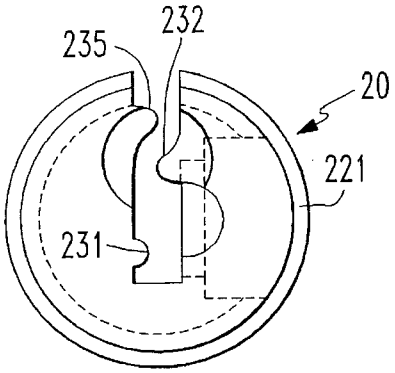
FIG. 20 is a front end view of a cylindrical plug 20 of the Eurocylinder-type lock in accordance with an embodiment of the invention shown in FIG. 1.
Figure 24:
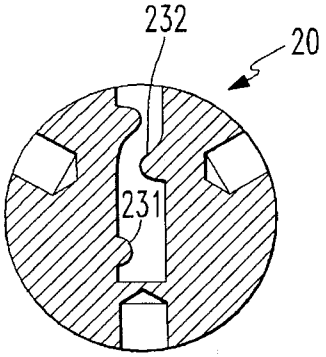
FIG. 24 is an end sectional view taken along lines 24—24 of FIG. 21.
Figure 25:
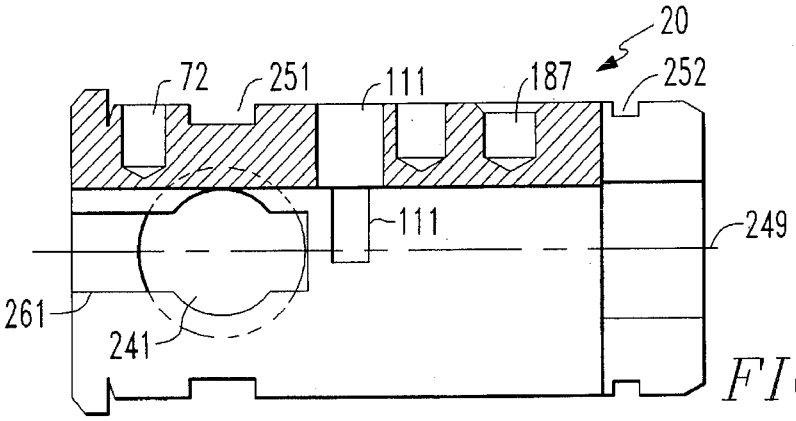
FIG. 25 is a side sectional view taken along lines 25—25 of FIG. 23.

Cylindrical bore 241 is sized to receive an insulating contact insert, shown at 253 in FIG. 30, and in detail in FIGS. 31 and 32. Specifically, contact insert 253 is comprised of a dielectric material, such as polycarbonate, and has a spherically contoured outer surface 255 from which a pair of tabs 257 and 259 extend. These tabs are sized to fit within a annular groove 251 of plug 20, as shown in FIGS. 21 and 25, so that the contact insert 253 may be captured in bore 241. The contact insert has a cylindrical bore 263 which extends from outer surface 255 to a base or bottom wall 265. A cylindrical bore 267, having a diameter smaller than that of and coaxial with bore 263 is formed in bottom wall 265.

Figure 33:
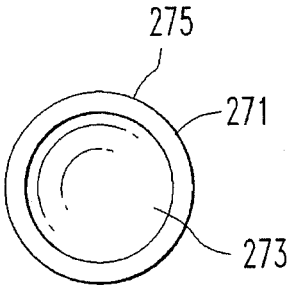
FIGS. 33 and 34 are respective end and side sectional views of a metallic cap.
Figure 34:
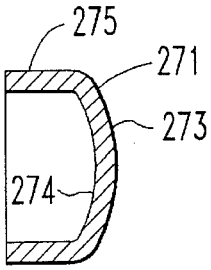

A conductive (metallic) cap, shown at 271 in FIG. 30 and in detail in FIGS. 33 and 34, is sized to fit within cylindrical bore 263 of contact insert 253. Conductive cap 271 has a generally spherically contoured base portion 273 which is continuous with a cylindrical wall portion 275. Cap 271 is dimensioned to fit within the interior bore 263 of contact insert 253 and has a length that is slightly smaller than the depth of bore 263, as shown in FIG. 30, so as allow for variations in manufacturing tolerances.

Figure 35:
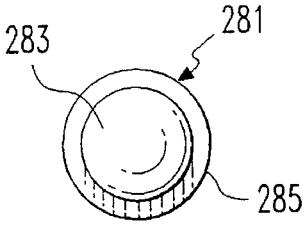
FIGS. 35 and 36 are respective end and side sectional views of a solid metallic contact.
Figure 36:
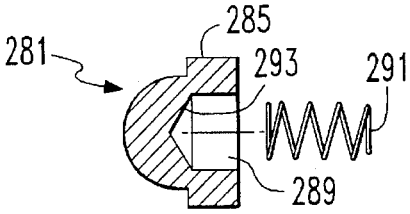
Figure 22:
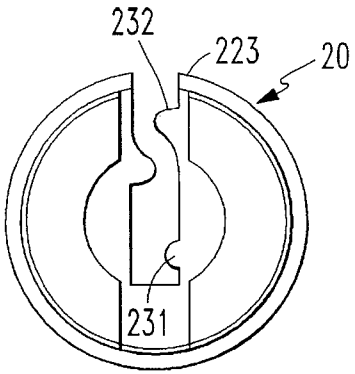
FIG. 22 is a rear end view of the plug 20 of FIG. 1.
Figure 26:
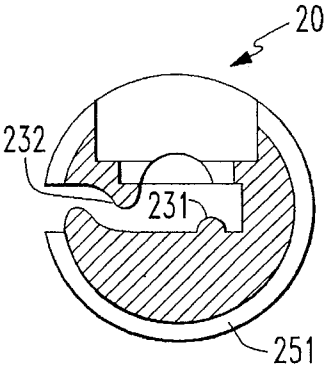
FIG. 26 is an end sectional view taken along lines 26—26 of FIG. 23.

Slidably disposed within the cylindrical wall portion 275 of conductive cap 271 is a translatable metallic contact shown at 281 in FIG. 30 and in detail in FIGS. 35 and 36. Metallic contact 281 has a generally spherical solid nipple portion 283 that is contiguous with a slightly wider diameter, generally cylindrical base portion 285. Nipple portion 283 is sized to pass through bore 267 in contact insert 253 and protrude just beyond the rear surface of base 265.

Extending from base portion 285 is a bore 289 that is sized to accommodate the insertion of one end of a compression spring, shown at 291. As shown in FIG. 30, compression spring 291 is seated between the interior surface 274 of the spherically contoured base portion 273 of conductive cap 271 and the interior end 293 of bore 289 of metallic contact 281.

Figure 27:
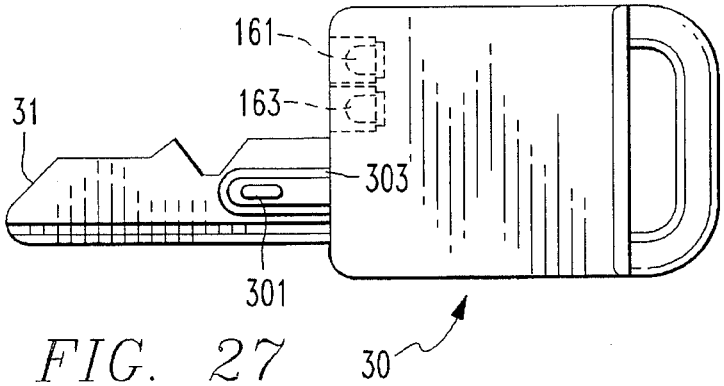
FIGS. 27–29 are respective diagrammatic left side, end and right side views of an electronic key.
Figure 28:
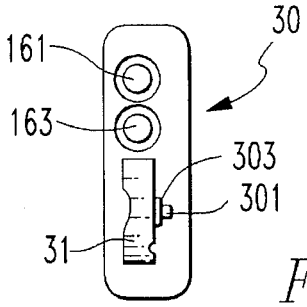
Figure 29:
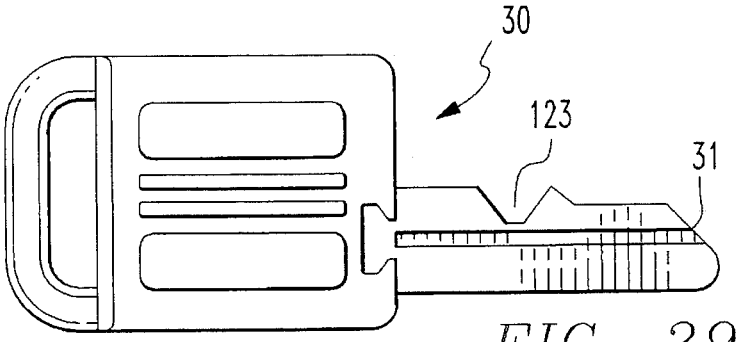

In their assembled configuration shown in FIG. 30, the dimensions of bore 241 in plug 20, the depth of contact insert 253, the length of conductive cap 271, and the dimensions of contact 281 are such that nipple portion 283 of contact 281 does not enter the keyway 25, so that contact 281 will not be contacted by the conductive keyblade 31 when the keyblade is inserted into the keyway. Instead, the slight protrusion of the nipple portion 283 of contact 281 through bore 267 of contact insert 253 is such that nipple portion 283 will be physically and electrically engaged by a raised terminal contact 301 that is insulated and physically offset from the main body of the keyblade 31, by means of an insulator layer 303, as shown in FIGS. 1, 27 and 28.

Namely, when the key is inserted into the keyway, the conductive blade 31 slides through the keyway until the keyblade is fully seated, with pin 113 captured in keyblade detent 123. In this position, raised terminal contact 301 has engaged contact 281 pushing against the bias of compression spring 291, so as to provide an electrically conductive path from the raised terminal contact 301, through translatable contact 281, to metallic cap 271.

Figure 37:
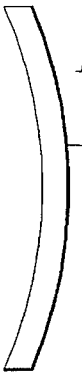
FIGS. 37 and 38 are respective side and end views of a fixed contact element.
Figure 38:
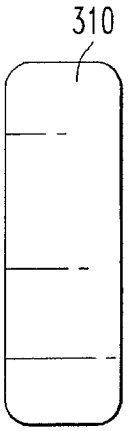
Figure 39:
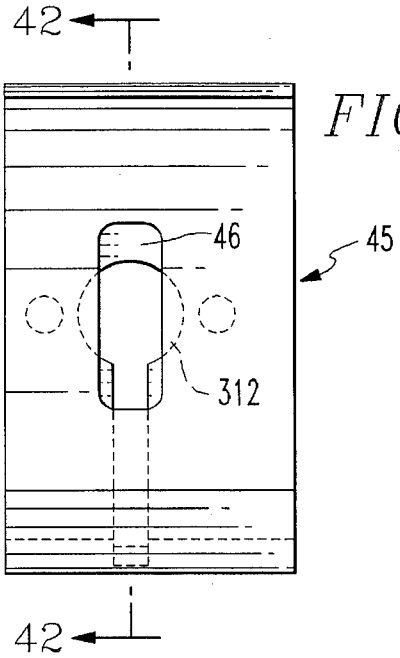
FIG. 39 is an interior side view of a contact holder.
Figure 40:
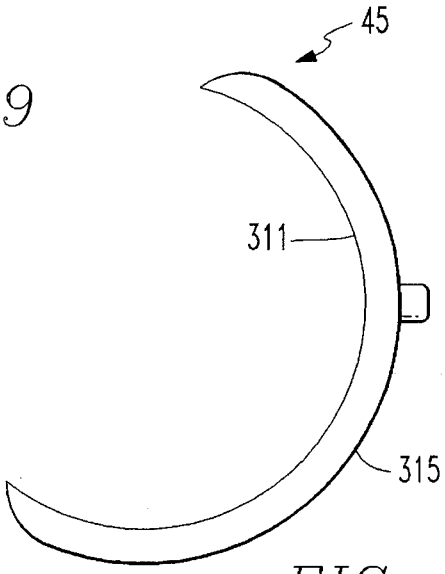
FIG. 40 is an end view of the contact holder of FIG. 39.
Figure 41:
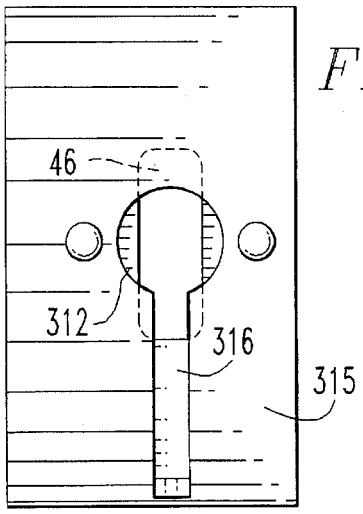
FIG. 41 is an exterior side view of the contact holder of FIG. 39.
Figure 42:
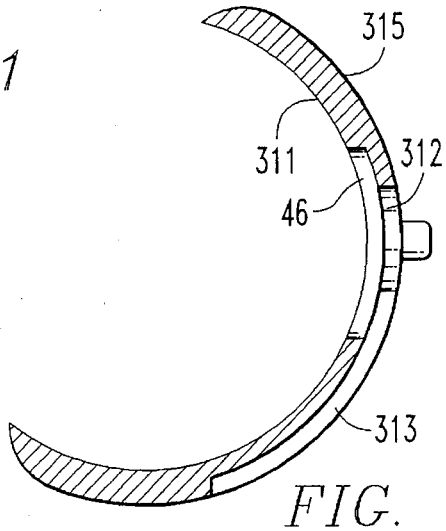
FIG. 42 is sectional view of a contact holder taken along lines 42—42 of FIG. 39.

The outer surface of spherically contoured base portion 273 of conductive cap 271 is arranged to be in contact with a fixed metallic contact, such a beryllium copper element, shown in detail at 310, in FIGS. 37 and 38, fixed metallic contact 310 being captured in recess 46 of insulating contact holder 45. The contact holder 45 itself is shown in detail in FIGS. 39–42 as an arcuate-shaped element having a generally rectangular perimeter which fits within the recess 34 of bore 21 of the cylindrical portion 13 of body 10. Generally rectangular shaped recess 46, in which fixed metallic contact 310 is inserted, is formed in an interior curved surface 311 and adjoins a generally circular end 312 of a recess 313 formed in the outer exterior curved surface 315 of insulating contact holder 45. Recess 313 has a generally elongate portion 316 that extends from circular end 312 along exterior surface 315 of contact holder 45. Elongate portion 316 of recess 313 is sized and shaped to receive a 'positive battery' contact flex circuit segment, shown at 320 in FIG. 30 and in detail in FIG. 43.

Similar to flex circuit strip 91, flex circuit segment 320 is formed of a generally elongated, thin dielectric strip, such as Mylar, in which a conductive track 321 is embedded. Conductive track 321 extends from a conductive pad 323 on one side of a first, generally enlarged disc-shaped connection end 325 of the dielectric strip to a terminal pad 327 accessible from both sides of a second end 329 of flex circuit segment 320. The conductive pad 323 on the disc-shaped connection end 325 of flex circuit segment 320 is intimately electrically bonded to contact element 310, as by means of conductive epoxy, or soldering.

Conductive track 321 provides a positive battery contact or power bus connection to the insulated terminal contact 301 on the keyblade. Terminal pad 329 is sized to engage pad 233 of flex circuit 91, described above with reference to FIG. 19, so that a continuous positive contact power bus connection is provided by way of the flex circuit structure that meanders through interior cavities of the lock body. Namely, the flex circuit structure (91–320) provides a conductive power link for one of the battery terminals (e.g. the positive (+) terminal), while the metallic body of the lock and the conductive keyblade provide a (ground) link for the other (–) battery terminal.

As will be appreciated from the foregoing description, pursuant to the present invention, the advantages of the architecture and functionality of the electronic lock and key system described in my above-referenced co-pending U.S. Patent Application, wherein each of respective lock and key devices is provided with on-board intelligence, the lock supplying power for each of the lock and the key, and communications between the lock and the key being effected by means of a secure bidirectional optical communication link are incorporated into a Eurocylinder-type of lock structure so that conventional mechanically actuated Eurocylinder configurations may be readily retrofitted to provide a secure electronic lock and key system.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. An assembly for an electronic lock and key system, said key having a handle portion housing an electronic circuit, and a conductive blade portion extending from said handle portion and including a conductive terminal portion mounted upon and insulated from said conductive blade portion, said conductive blade portion and said conductive terminal portion being electrically connected to said electronic circuit, said assembly comprising:

a generally cylindrical body having a keyway therein, said keyway being sized to receive the conductive blade portion of said key, said generally cylindrical body further having a slot extending through a wall portion of said cylindrical body, said slot having a first axis generally transverse to and intersecting said keyway;

an electrically insulating contact insert disposed within said slot;

a translatable electrically conductive contact disposed within said electrically insulating contact insert so as to be translatable along said first axis and engageable by said conductive terminal portion of said key, when said key is inserted into said keyway;

an electrically conductive fixed contact element supported adjacent to said slot and positioned to be conductively engageable with said conductive terminal portion of said key by means of said translatable electrically conductive contact, when said translatable electrically conductive contact is engaged by said conductive terminal portion of said key, when said key is inserted into said keyway;

a flexible insulated conductor link conductively coupled to said electrically conductive fixed contact element; and a solenoid device having a movable plunger that is translatable along a second axis that intersects said generally cylindrical body, and wherein said generally cylindrical body has a first bore that is alignable with said second axis, and is sized to receive said movable plunger, such that said movable plunger, when inserted into said first bore, prevents rotation of said cylindrical body until said movable plunger is translated out of said first bore by the operation of said solenoid device.

2. An assembly according to claim 1, wherein said translatable electrically conductive contact is biased within said contact insert so as to be urged along said first axis toward said keyway, such that said translatable electrically conductive contact is engaged by said conductive terminal portion of said key when said conductive blade portion of said key is inserted into said keyway.

3. An assembly according to claim 2, wherein said electrically insulating contact insert is configured to limit translation of said electrically conductive contact along said first axis as said translatable electrically conductive contact is biased to a position adjacent to said keyway, such that said conductive blade portion of said key passes by said translatable electrically conductive contact when said key is inserted into said keyway.

4. An assembly according to claim 1, further including a housing having a generally cylindrical cavity in which said generally cylindrical body is inserted, said generally cylindrical cavity containing an electrically insulating fixed contact element holder that includes a recess disposed in an interior surface portion thereof, said recess facing said slot, said recess supporting said electrically conductive fixed contact element adjacent to said slot such that said electrically conductive fixed contact element is conductively engaged by said translatable electrically conductive contact when said translatable electrically conductive contact is translated along said first axis by being engaged by said conductive terminal portion of said key.

5. An assembly according to claim 4, wherein said electrically insulating fixed contact element holder has a passageway sized to accommodate said flexible insulated conductor link extending into electrical contact with said fixed contact element.

6. An assembly according to claim 1, wherein said electrically conductive fixed contact element is comprised of flexible conductive material so as to ensure electrical coupling between said translatable electrically conductive contact and said flexible insulated conductor link when said translatable electrically conductive contact is translated along said first axis into conductive contact with said fixed contact element by being engaged by said conductive terminal portion of said key.

7. An assembly according to claim 1, wherein said generally cylindrical body further includes a second bore extending from a first outer surface portion of said cylindrical body to a prescribed depth intersecting said keyway, said second bore being sized to receive a first pin that is engageable by said conductive blade portion of said key.

8. An assembly according to claim 7, wherein said depth of said second bore corresponds to the length of said first pin.

9. An assembly according to claim 7, further including a housing having a first cavity that is configured to accommodate said generally cylindrical body, and a second cavity adjacent to said first cavity and being sized to receive a cam member that is mountable with said generally cylindrical body, such that rotation of said generally cylindrical body within said first cavity of said housing causes rotation of said cam member within said second cavity of said housing, and wherein said housing further includes a third bore that extends generally transversely of said first cavity, and is sized and located so as to be alignable with said second bore in said generally cylindrical body, said third bore receiving a second pin that is biased toward said first pin in said second bore, so that said second pin may contact and urge said first pin through said second bore to engage said conductive blade portion of said key.

10. An assembly according to claim 9, wherein said housing further includes a third cavity that is configured to receive a first opto-electronic communication unit, said first opto-electronic communication unit being operative to communicate with a second opto-electronic communication unit retained by said handle portion of said key, and wherein a flex circuit, to which said flexible conductor link is connected, is provided in said third cavity and is connectable to said first opto-electronic communication unit.

11. An assembly according to claim 10, wherein said housing further includes a fourth cavity that communicates with said first cavity and is configured to accommodate said solenoid device therein and wherein said flex circuit is connected to said solenoid device.

12. An assembly according to claim 11, further including a plurality of regions of hardened material that prevent forced penetration access to components in cavities of said housing and generally cylindrical body.

13. An assembly according to claim 9, wherein said translatable electrically conductive contact is biased within said contact insert so as to be urged along said first axis toward said keyway, such that said translatable electrically conductive contact is engaged by said conductive terminal portion of said key when said conductive blade portion of said key is inserted into said keyway.

14. An assembly according to claim 13, wherein said electrically insulating contact insert is configured to limit translation of said translatable electrically conductive contact along said first axis as said translatable electrically conductive contact is biased to a position adjacent to said keyway, such that said conductive blade portion of said key passes by said translatable electrically conductive contact when said conductive blade portion of said key is inserted into said keyway.

15. An assembly according to claim 14, wherein said first cavity retains therein an electrically insulating fixed contact element holder that includes a recess disposed in an interior surface portion thereof, said recess facing said slot, said recess supporting said electrically conductive fixed contact element adjacent to said slot such that said electrically conductive fixed contact element is conductively engaged by said translatable electrically conductive contact when said translatable electrically conductive contact is translated along said first axis to be engaged by said conductive terminal portion of said key.

16. An assembly according to claim 15, wherein said electrically insulating fixed contact element holder has a passageway sized to accommodate said flexible insulated conductor link extending into electrical contact with said fixed contact element.

17. An assembly according to claim 16, wherein said electrically conductive fixed contact element is comprised of flexible conductive material so as to ensure electrical coupling between said translatable electrically conductive contact and said flexible insulated conductor link when said translatable electrically conductive contact is translated along said first axis into conductive contact with said fixed contact element by being engaged by said conductive terminal portion of said key.

18. An assembly according to claim 1, further including a solenoid housing having a longitudinal cylindrical bore therethrough, said longitudinal cylindrical bore being surrounded by a solenoid winding of said solenoid device, said movable plunger being slidably translatable along said second axis, said second axis being a longitudinal axis within said longitudinal cylindrical bore, said moveable plunger having a stem and being mechanically biased by a compression spring that rides on said stem within said longitudinal cylindrical bore, said compression spring being fitted between a first surface of said moveable plunger and a bottom interior surface of said longitudinal cylindrical bore of said solenoid housing, said spring being operative, in the absence of the energization of said solenoid winding, to bias said moveable plunger away from the bottom interior surface of said longitudinal cylindrical bore, whereas energization of said solenoid winding is effective to translate said moveable plunger toward the bottom interior surface of said longitudinal cylindrical bore.

19. An assembly according to claim 1 further including a housing having a first cavity that is configured to accommodate said generally cylindrical body, and a second cavity adjacent to said first cavity and being sized to receive a cam member that is mountable with said generally cylindrical body, such that rotation of said generally cylindrical body within said first cavity of said housing causes rotation of said cam member within said second cavity of said housing.

20. An assembly according to claim 19, wherein said housing further includes a third cavity that communicates with said first cavity and is configured to accommodate said solenoid device therein.

21. An assembly according to claim 20, wherein said housing further includes a fourth cavity that is configured to accommodate the insertion of said flexible conductor link therein and a flex circuit to which said flexible conductor link is connected, said flex circuit being connected to said solenoid device.

22. An assembly for an electronic lock and key system, said key having a handle portion housing an electronic circuit, and a conductive blade portion extending from said handle portion and including a conductive terminal portion mounted upon and insulated from said conductive blade portion, said conductive blade portion and said conductive terminal portion being electrically connected to said electronic circuit, said assembly comprising:

a conductive housing having a generally cylindrical first housing portion and a generally elongated second housing portion solid with said first housing portion, said first housing portion having a longitudinal bore into which a cylindrical key-receiving plug is inserted, said plug having a keyway being rotatable by the turning of said key that has been inserted into said keyway and electronically verified to have permission to operate the lock;

a lock operating element mounted with said plug, said lock operating element being rotatable in a cavity formed in said second housing portion;

an insulating contact element holder disposed in said longitudinal bore, said contact element holder containing a fixed metallic contact element and a flex circuit connected thereto;

said plug having a slot which intersects said keyway, said slot containing a translatable electrically conductive contact which is electrically connected with said fixed metallic contact element and supported in said slot for contact with said conductive terminal portion of said key but not said blade portion of said key; and a solenoid device to which said flex circuit is electrically coupled, said solenoid device having a moveable plunger that is arranged to be translatable into and out of a plunger-receiving bore in said plug, said moveable plunger being biased to normally be inserted into said plunger-receiving bore, so as to engage said plug and thereby prevent rotation of the plug, but, in response to energization of said solenoid device, being translated out of said plunger-receiving bore in said plug, so as to allow rotation of said plug in the longitudinal bore in said first housing portion.

23. An assembly according to claim 22, wherein said second housing portion further includes an additional housing bore alignable with a corresponding additional bore in said plug, said additional housing bore containing a first pin biased toward said plug, said corresponding additional bore in said plug extending to a prescribed depth in said keyway, and having a second pin which is of such a length that, when said key is inserted into said keyway, said corresponding additional bore is axially aligned with said additional housing bore and said second pin is captured within a detent in said blade portion.

24. An assembly according to claim 23, wherein the length of said second pin is such that said second pin is flush with the outer cylindrical surface of the plug when said key is inserted in said keyway to capture said second pin within said detent in said blade portion.

25. An assembly according to claim 22, wherein a front end portion of said second housing portion contains an opto-electronic communication unit having opto-electronic transmit and receive devices, which are operative to communicate with mutually aligned receive and transmit opto-electronic modules of an opto-electronic communication unit within said handle portion of said key.

26. An assembly according to claim 25 wherein electrical connections to the opto-electronic transmit and receive devices of said second housing portion are provided by way of said flex circuit.

27. An assembly according to claim 22, further including a plurality of regions of hardened material that prevent forced penetration access to components in cavities of said housing and said plug.

28. An assembly according to claim 22, further wherein the slot in said plug contains an insulating contact insert having a first bore which extends from an outer surface portion thereof to a base thereof, and a second, reduced diameter bore formed in said base, a conductive cap disposed within said first bore of said insulating contact insert, said translatable electrically conductive contact having a nipple portion that passes through said second bore in said base of said contact insert and protrudes to a position adjacent to said keyway.

29. An assembly according to claim 28, wherein said translatable electrically conductive contact has a bore that accommodates one end of a compression spring, the other end of which is seated against an interior surface of said conductive cap, and wherein said slot, said contact insert, said conductive cap and said translatable electrically conductive contact are dimensioned such that said nipple portion of said translatable electrically conductive contact does not enter the keyway, so that said translatable electrically conductive contact will not be contacted by said conductive blade portion of said key when said key is inserted into said keyway.

30. An assembly according to claim 28, wherein said translatable electrically conductive contact has a bore that accommodates one end of a compression spring, the other end of which is seated against an interior surface of said conductive cap, and wherein said slot, said contact insert, said conductive cap and said translatable electrically conductive contact are dimensioned such that only said nipple portion of said translatable electrically conductive contact will be physically and electrically engaged by said conductive terminal portion of said key, when the key is inserted into the keyway.

31. An assembly according to claim 22, wherein said insulating contact element holder has an interior surface depression in which said fixed metallic contact element is disposed and an exterior surface channel in which said flex circuit is disposed, said exterior surface channel communicating with said interior surface depression and containing a portion of said flex circuit.

32. An assembly according to claim 22, further including a solenoid housing portion having a longitudinal cylindrical bore therethrough, said longitudinal cylindrical bore being surrounded by a solenoid winding of said solenoid device, said movable plunger being slidably translatable along a longitudinal axis within said longitudinal cylindrical bore, said moveable plunger having a stem and being mechanically biased by a compression spring that rides on said stem within said longitudinal cylindrical bore, said compression spring being fitted between a first surface of said moveable plunger and a bottom interior surface of said longitudinal cylindrical bore of said solenoid housing portion, said spring being operative, in the absence of the energization of said solenoid winding, to bias said moveable plunger away from the bottom interior surface of said longitudinal cylindrical bore, whereas energization of said solenoid winding is effective to translate said moveable plunger toward the bottom interior surface of said longitudinal cylindrical bore.

* * * * *